US011957225B1

(12) United States Patent
Zorn

(10) Patent No.: US 11,957,225 B1
(45) Date of Patent: Apr. 16, 2024

(54) BAG WITH AN ILLUMINATING DEVICE

(71) Applicant: Darren S Zorn, Fort Worth, TX (US)

(72) Inventor: Darren S Zorn, Fort Worth, TX (US)

( * ) Notice: Subject to any disclaimer, the term of this patent is extended or adjusted under 35 U.S.C. 154(b) by 0 days.

(21) Appl. No.: 18/218,471

(22) Filed: Jul. 5, 2023

Related U.S. Application Data

(60) Provisional application No. 63/458,594, filed on Apr. 11, 2023.

(51) Int. Cl.
*A45C 15/06* (2006.01)
*A45C 3/00* (2006.01)

(52) U.S. Cl.
CPC ..... *A45C 15/06* (2013.01); *A45C 3/00* (2013.01)

(58) Field of Classification Search
CPC ..... A45C 15/06
See application file for complete search history.

(56) References Cited

U.S. PATENT DOCUMENTS 1,183,268 A * 5/1916 Baldwin et al. ..... A45C 15/06 132/288
4,926,296 A * 5/1990 Blume ..... A45C 15/06 428/34.3
6,158,872 A * 12/2000 Rodgers ..... H05B 39/09 362/802
6,200,000 B1 * 3/2001 Burnidge ..... A45C 15/06 362/249.05
6,499,857 B1 * 12/2002 Lumley ..... A45C 15/06 362/183
9,022,595 B1 * 5/2015 Schilling ..... F21V 33/0028 362/154
2002/0105798 A1 * 8/2002 Hill ..... A45C 13/28 362/156
2007/0133195 A1 * 6/2007 Gorton ..... A45C 15/06 362/156
2012/0002404 A1 * 1/2012 Ma ..... F21V 33/0024 362/154
2012/0042996 A1 * 2/2012 Glynn ..... H01M 10/465 362/100
2014/0041772 A1 * 2/2014 Hayes ..... A45C 15/06 150/106

* cited by examiner

*Primary Examiner* — Eric T Eide
(74) *Attorney, Agent, or Firm* — Richard Eldredge; Leavitt and Eldredge Law Firm

(57) ABSTRACT

An illuminating bag with one or more illuminating elements on the interior and exterior of the body of the bag, for providing visibility inside and outside of the bag, comprising a body, one or more handles, and one or more fastening elements, wherein the body can be made of one or more panels positioned around the base, and can be operated in an open and a closed configuration, the fastening elements function as an automatic switch to operate the illuminating elements on the interior of the bag. The handles further include a multifunctional switch to operate the illuminating elements on the exterior of the bag, in different directions.

1 Claim, 1 Drawing Sheet

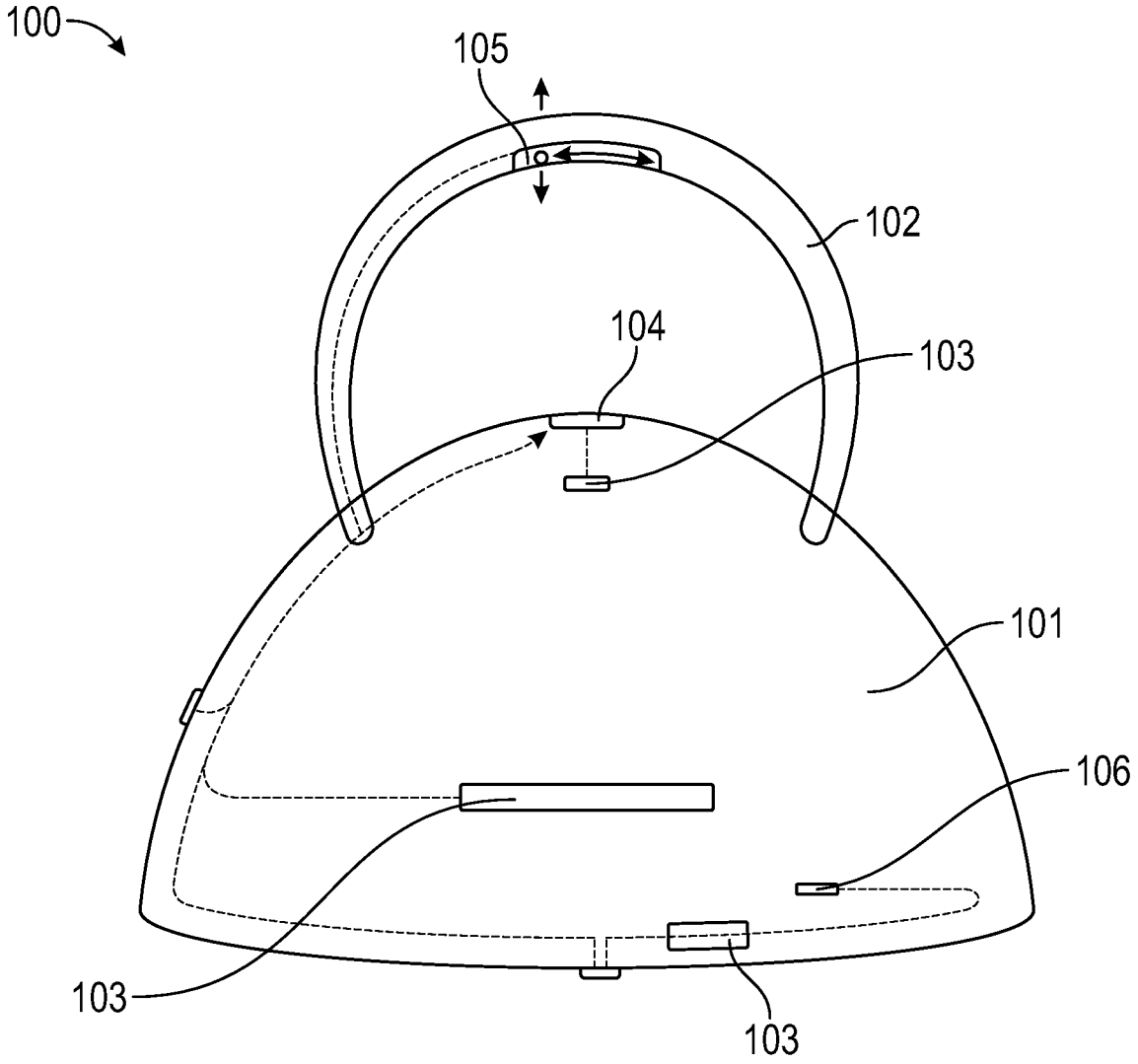
100
105
102
104
103
101
106
103
103

BAG WITH AN ILLUMINATING DEVICE

BACKGROUND

1. Field of the Invention

The present invention relates generally to bags, and more specifically to an illuminating bag comprising one or more illuminating devices for providing visibility inside and outside of the bag.

2. Description of Related Art

A bag or sack is a common tool in the form of a non-rigid container with or without handles. The use of bags predates recorded history, with the earliest bags being lengths of animal skin, cotton, or woven plant fibers, folded up at the edges and secured in that shape with strings of the same material. Sometimes finding things inside the bags can be difficult, especially in poor visibility conditions, and there is a need to improve the utility of the bags.

Accordingly, although great strides have been made in the area of bags, many shortcomings remain.

DESCRIPTION OF THE DRAWINGS

The novel features believed characteristic of the embodiments of the present application is set forth in the appended claims. However, the embodiments themselves, as well as a preferred mode of use, and further objectives and advantages thereof, will best be understood by reference to the following detailed description when read in conjunction with the accompanying drawings, wherein:

FIG. 1 is a perspective view of an illuminating bag of the present invention.

While the illuminating bag and method of use of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the illuminating bag and the method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The illuminating bag and method of use will be understood, both as to its structure and operation, from the accompanying drawings, taken in conjunction with the accompanying description. Several embodiments of the bag are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein reference characters identify corresponding or similar elements throughout the several views, FIG. 1 depict a perspective view of an illuminating bag comprising one or more illuminating devices in accordance with a preferred embodiment of the present application. It will be appreciated that the bag 100 overcomes one or more of the above-listed problems commonly associated with bags. In addition, it should be appreciated that more or fewer such components may be included in different embodiments of the bag 100.

In the contemplated embodiment, the illuminating bag 100 includes a body 101 and one or more handles 102. The bag 100 further includes one or more illuminating elements 103 on the interior and on the exterior of the bag 100. The body 101 can be made of one or more panels positioned around a base. The body 101 can be operated in an open configuration and a closed configuration with the help of a fastening element 104.

The fastening element 104 further facilitates illuminating the interior of the bag automatically by acting as a switch to turn one or more illuminating elements 103 ON and OFF in the open and closed configuration respectively, of the body 101.

The fastening element 104 can be a magnetic element or a latching element or any other suitable fastening element to facilitate the opening and closing of the body 101.

One or more handles 102 of the bag 100 further include a multifunctional switch 105 to facilitate switching ON/OFF of one or more illuminating elements 103 located on the exterior of the bag 100. One or more illuminating element/s 103 can be located on the exterior of the body 101 to illuminate in different directions including but not limited to forward or downward or backward directions.

The multifunctional switch 105 can be operated to switch ON one or more illuminating elements 103, for example by clicking once to illuminate in a forward direction, by clicking twice to illuminate in a downward direction, by clicking thrice to illuminate in forward and downward directions at the same time.

The multifunctional switch 105 can be permanently sewn in the handles 102, or attached to handles 102 by any other suitable means. The multifunctional switch 105 can be moved from one side or one handle of the bag 100 to the other side or handle to facilitate operation by the left or right hand of the person using the bag.

It is also contemplated and will be appreciated that bag 100 of the present invention includes a power source 106 which supplies power to the illuminating elements present on the interior and exterior of the bag 100. The power source

106 can be including but is not limited to a battery or USB cable, or AC or DC power supply.

It is also contemplated and will be appreciated that bag 100 of the present invention includes illuminating elements, which can be a light source of different shapes, sizes, and kinds including but not limited to LED strips, LED bulbs, or other suitable illuminating elements.

It is also contemplated and will be appreciated that bag 100 of the present invention can be made of any suitable material including but not limited to rubber, vinyl, plastic, fabric, leather, PVC, composite fiber, carbon fiber, or any other suitable composite material.

The bag 100 of the present invention can be removably attached to any surface or article of interest including but not limited to an article of clothing of the user such as a shirt, jacket, or hoodie.

It should also be appreciated that one of the unique features believed characteristic of the present application is that it facilitates illuminating the interior of the bag to find things easily and also facilitates illuminating the exterior of the bag, to walk or assist to carry out any activities in poor lighting conditions.

The bag 100 of the present invention can be any kind of bag or sack including but not limited to handbags, shoulder bags, backpacks, sling bags, potli bags, clutches, or purses. The bag of the present invention provides illumination in the interiors to help with finding things and is convenient to use. The bag of the present invention is easy to use, and operate.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An illuminating bag with one or more illuminating elements on the interior and exterior for providing visibility inside and outside of the bag, including:

a body;

one or more handles;

a fastening element;

wherein the said body is made of one or more panels positioned around a base;

wherein the said body can be operated in an open configuration and a closed configuration using said fastening element;

wherein the said fastening element facilitates illuminating the interior of the bag automatically by acting as a switch to operate the said illuminating elements ON or OFF;

wherein the said handles further include a multifunctional switch;

wherein the said multifunctional switch facilitates illuminating the exterior of the bag by acting as a switch to operate the said illuminating elements ON or OFF;

wherein the said multifunctional switch facilitates to operate the said one or more illuminating elements located on the exterior of the bag, in forward or downward or backward directions;

wherein the said multifunctional switch operates by clicking once to illuminate in a forward direction, by clicking twice to illuminate in a downward direction, by clicking thrice to illuminate in forward and downward directions at the same time.

* * * * *